United States Patent [19]

Onaka

[11] 4,273,092

[45] Jun. 16, 1981

[54] EXHAUST GAS RECIRCULATION SYSTEM WITH ENGINE LOAD DEPENDENT PERFORMANCE

[75] Inventor: Hidemi Onaka, Susono, Japan

[73] Assignee: Toyota Jidosha Kogyo Kabushiki Kaisha, Aichi, Japan

[21] Appl. No.: 58,518

[22] Filed: Jul. 18, 1979

[30] Foreign Application Priority Data

Dec. 22, 1978 [JP] Japan ..... 53-160593

[51] Int. Cl.[3] ..... F02B 47/08

[52] U.S. Cl. ..... 123/568

[58] Field of Search ..... 123/119 A; 125/568

[56] References Cited

U.S. PATENT DOCUMENTS

| | | | |
|---|---|---|---|
| 4,092,960 | 6/1978 | Nohira et al. | 123/119 A |
| 4,180,035 | 12/1975 | Saiki et al. | 123/119 A |

*Primary Examiner*—Wendell E. Burns

*Attorney, Agent, or Firm*—Stevens, Davis, Miller & Mosher

[57] ABSTRACT

An exhaust gas recirculation system is disclosed, which is of the well-known type wherein an exhaust gas recirculation control valve in the exhaust gas recirculation passage controls the amount of exhaust gas recirculation. An orifice element, upstream of the exhaust gas recirculation valve in the passage, defines a pressure chamber between itself and the exhaust gas recirculation control valve. The vacuum supplied to the diaphragm chamber of the exhaust gas recirculation control valve is modified by a vacuum adjustment valve with two chambers on opposite sides of a biased diaphragm, the one chamber being supplied with the pressure in the pressure chamber, and the other chamber being supplied with atmospheric air through an air bleed means at a certain rate. The improvement of the present invention comprises varying the performance of the supply of air through the air bleed means in accordance with the load on the engine. In preferred embodiments the air bleed means incorporates an air bleed control valve which varies the amount of air bled in various ways in accordance with the vacuum at various particular points in the inlet manifold.

2 Claims, 2 Drawing Figures

EXHAUST GAS RECIRCULATION SYSTEM WITH ENGINE LOAD DEPENDENT PERFORMANCE

BACKGROUND OF THE INVENTION

The present invention relates to a device for exhaust gas recirculation control in an internal combustion engine, and more particularly relates to a device for controlling exhaust gas recirculation, in an internal combustion engine as used in a road vehicle or the like, which matches the ratio of exhaust gas recirculation appropriately to the load to which the engine is subjected.

It is already known, as an example of an exhaust gas recirculation control device for a motor vehicle internal combustion engine, to utilize a back pressure control type exhaust gas recirculation control device, which is provided with: an exhaust gas recirculation control valve, incorporated in the exhaust gas recirculation passage, which responds to an increase in the vacuum which is supplied to its diaphragm chamber by more opening said exhaust gas recirculation passage; a passage means for bringing the vacuum to the diaphragm chamber of the exhaust gas recirculation control valve; an orifice element formed in the exhaust gas recirculation path on the upstream side of the exhaust gas recirculation control valve, so as to define a pressure chamber between itself and the exhaust gas recirculation control valve; and a vacuum control valve mounted on said passage for bringing vacuum. In such an exhaust gas recirculation control device, the exhaust gas recirculation control valve is operated by vacuum which is adjusted, in response to the exhaust gas pressure in the pressure chamber, by the operation of the vacuum control valve. By keeping the pressure in the pressure chamber at a substantially constant value, fairly close to atmospheric pressure, the amount of exhaust gas recirculation, relative to the amount of inlet air, or in other words the exhaust gas recirculation ratio, is held substantially constant while the exhaust gas recirculation is carried out.

In this back pressure control type of exhaust gas recirculation control device, irrespective of the engine load, the exhaust gas recirculation ratio is kept substantially constant. In this case, if the exhaust gas recirculation ratio is low, no particular problems arise; but if the exhaust gas recirculation ratio is made higher in order to make more effective the reduction of NOx emission from the engine, the problem arises that the drivability of the engine is worsened when it is operated under low load conditions, and, depending on the characteristics of the individual engine, the drivability may also worsen when the engine is operated under high load conditions.

The worsening of drivability under conditions of low load is caused by the fact that under conditions of low load the residual amount of exhaust gas remaining in the combustion chambers of the engine increases, and thus the effective exhaust gas recirculation ratio ([recycled exhaust+residual exhaust gas]/air intake amount) becomes too high. The worsening of drivability under conditions of high load is because the reduction in engine output brought about by the recirculation of exhaust gases makes the acceleration of the engine lower.

Therefore, in order to carry out exhaust gas recirculation without worsening the drivability of the vehicle incorporating the internal combustion engine, and still sufficiently to reduce the quantity of NOx emissions to comply with the standards for control of exhaust emission, which are becoming more and more severe nowadays, it is desirable that the exhaust gas recirculation ratio should be matched to the load of the engine in such a manner that the exhaust gas recirculation ratio is lowered in low load operation compared to medium load operation; or, alternatively, that the exhaust gas recirculation ratio is lowered in low and high load operation compared to medium load operation.

SUMMARY OF THE INVENTION

It is therefore an object of the present invention to provide, in response to the above requirements, an exhaust gas recirculation control device, in which the exhaust gas recirculation ratio is matched to the load on the engine.

In order to meet this object, the present invention provides for altering the balance characteristics of the vacuum control valve in a back pressure control type exhaust gas recirculation control system, and, depending on this, altering the balance pressure value of the pressure chamber; thus controlling the exhaust gas recirculation ratio in response to the load on the internal combustion engine.

Therefore, according to the present invention, an exhaust gas recirculation system for an internal combustion engine comprising an exhaust passage, an inlet manifold, and a throttle valve in the inlet manifold is provided, comprising: an exhaust gas recirculation passage leading from a part of the exhaust passage to a part of the inlet manifold downstream of the throttle valve; an orifice element provided within the exhaust gas recirculation passage; an exhaust gas recirculation control valve, provided at the downstream of the orifice element, so as to define a pressure chamber in the exhaust gas recirculation passage between itself and the orifice element, comprising: a first diaphragm, a first diaphragm chamber, defined on one side of the first diaphragm, a first valve element coupled to the first diaphragm, and a first valve seat co-operating with the first valve element to form a variable aperture in the exhaust gas recirculation passage, increase in the vacuum supplied to the first diaphragm chamber increasing the opening amount of the variable aperture; a first passage which supplies vacuum to the first diaphragm chamber; a vacuum control valve, which comprises: a second diaphragm, a second diaphragm chamber, defined on one side of the second diaphragm, to which is admitted the pressure of the exhaust gas in the pressure chamber, a third diaphragm chamber, defined on the other side of the second diaphragm, a second valve seat communicating the third diaphragm chamber to the first passage; and a second valve element, supported by the second diaphragm and co-operating with the second valve seat so as to close the second valve seat when the pressure in the second diaphragm chamber exceeds the pressure in the third diaphragm chamber by more than a certain amount, and to open the second valve seat when the pressure in the second diaphragm chamber does not exceed the pressure in the third diaphragm chamber by more than this certain amount; and an atmosphere inlet means which admits atmospheric air, presenting a resistance to the passage thereof, into the third diaphragm chamber; characterized in that: the resistance of the atmosphere inlet means to the passage of atmospheric air is varied in accordance to a quantity which is related to the load on the engine.

With this construction, the exhaust gas recirculation control valve is operated by a vacuum controlled in response to the exhaust gas pressure in the pressure chamber by the said vacuum control valve. The pressure in the pressure chamber is maintained close to atmospheric pressure, but is slightly changed according to the opening of the intake throttle valve, and exhaust gas is recycled at a recirculation amount determined by the difference between the pressure in the exhaust passage and the pressure in the pressure chamber thus controlled and the flow coefficient and cross sectional area of the orifice element.

In this case, the exhaust gas recirculation amount Ge is determined according to the following relationship:

$$Ge = CAo\ sqrt[(2\ g/r)\ mod(Pe-Pc)] \quad (1)$$

where:

C is the orifice element flow coefficient,

Ao is the orifice element cross-sectional area, r is the specific density of the exhaust gases, Pe is the exhaust gas pressure in the exhaust gas passage, and Pc is the exhaust gas pressure in the pressure chamber.

The pressure Pc in the pressure chamber is determined by the equilibrium of the vacuum control valve, which is determined by the following relation:

$$Ad\ Pd + F = Ad\ Pc$$

where:

Ad is the pressure responsive area of the second diaphragm, or the diaphragm of the vacuum control valve, Pd is the pressure of the third diaphragm chamber, and F is the spring force exerted in the direction of opening the second valve seat.

The pressure Pd in the third diaphragm chamber is normally a slight vacuum, close to atmospheric pressure, but, as the effective cross-sectional area of the atmosphere inlet means which allows atmospheric air to be introduced into the third diaphragm chamber is increased, the pressure Pd is further increased closer to atmospheric pressure, and therefore with an increase in the effective cross-sectional area of the atmosphere inlet means will come a rise in the pressure Pc in the pressure chamber. As a result, since the difference between the pressure Pc and the exhaust gas pressure Pe in the exhaust gas passage will be less, the amount Ge of exhaust gas recycled will also be less. Therefore, with a particular constitution of the present invention, the effective cross-sectional area of the atmosphere inlet means is controlled by an air bleed valve device to respond to the throttle opening amount, which is a value related to the load on the engine, so that the exhaust gas recirculation ratio is controlled in response to the engine load.

Further, with the device of the present invention, since the air bleed valve device controls the effective cross-sectional area of the atmosphere inlet means, so that the pressure of the third diaphragm chamber of the vacuum control valve is properly controlled, by the suitable design of the valve element of the air bleed valve the control of the exhaust gas recirculation ratio can be performed suitably in response to the engine load. In other words, it is possible to set the exhaust gas recirculation ratio control characteristics with respect to the engine load with a high degree of freedom in the design characteristics.

When the exhaust gas recirculation ratio is only to be made less in low load operation of the internal combustion engine, but is not to be made less in high load operation, than in medium load operation, the air bleed valve device may be constructed so as to be operated by the inlet vacuum obtained from an inlet vacuum extraction port formed in the engine inlet manifold so as to be the same as the inlet vacuum when the throttle valve opening is less than or equal to a certain value, and to be substantially at atmospheric pressure when the throttle valve opening is beyond that said value. In this case, the air bleed valve device may be constructed so that the effective cross-sectional area of the atmosphere inlet means is increased in response to an increase in the vacuum allowed into its diaphragm chamber.

When the exhaust gas recirculation ratio is to be controlled so that it is lower in both high and low load operation of the engine than in medium load operation, the construction may be such that the air bleed valve device is operated by the inlet vacuum provided by an inlet vacuum extraction port provided in the engine inlet manifold so as to be substantially open to the atmosphere when the throttle opening is below a certain predetermined value, and open to the inlet vacuum when the throttle opening reaches or goes beyond that value. In this case, the air bleed valve device may also be constructed so that the effective cross-sectional area of the atmosphere inlet means is decreased in response to an increase in the vacuum.

BRIEF DESCRIPTION OF THE DRAWINGS

The present invention will become more clearly understood with reference to the following description of preferred embodiments thereof, and with reference to the accompanying drawings. It should be clearly understood, however, that the descriptions of the embodiments, and the drawings, are given for the purposes of illustration and explanation only, and are not intended to limit the scope of the present invention, or of the protection sought to be granted, in any way; these are to be defined solely by the accompanying claims. In the drawings, like figures refer to like parts in the embodiments shown in different drawings, and:

DESCRIPTION OF THE PREFERRED EMBODIMENTS

Figure 1:
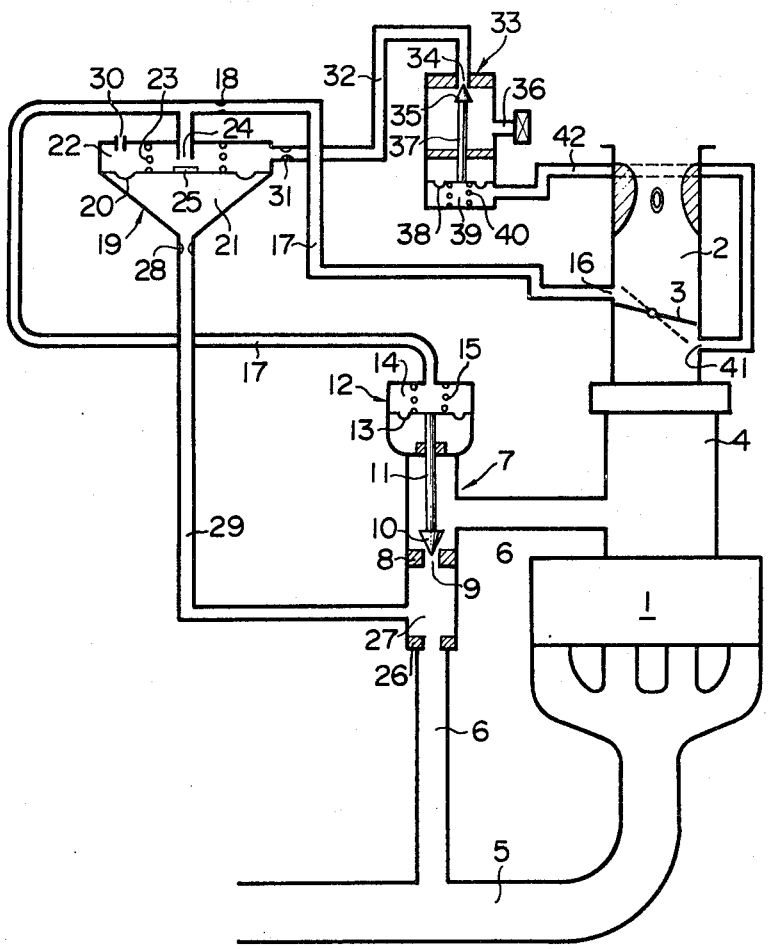
FIG. 1 is a schematic illustration, showing one embodiment of the exhaust gas recirculation system of the present invention, as fitted to an internal combustion engine.

Referring to FIG. 1, there is shown a first embodiment of the exhaust gas recirculation system according to the present invention.

An engine 1 receives a mixture of air and fuel which is formed in a carburetor 2, and the amount of which is controlled by a throttle valve 3, which in this embodiment is a butterfly valve, through an inlet manifold 4. The engine expels exhaust gas through an exhaust pipe 5. For the purpose of recycling a proportion of the exhaust gas flowing through the exhaust pipe 5 from an intermediate point in the exhaust pipe 5 to the inlet manifold 4, an exhaust gas recirculation passage 6 is provided, and the amount of exhaust gas flowing through this exhaust gas recirculation passage 6 is controlled by an exhaust gas recirculation control valve, designated as a whole by 7.

The exhaust gas recirculation control valve 7 is provided with a valve seat element 8 defining a valve port 9 through which the exhaust gas which is being recycled passes, and the effective opening amount of this valve port 9 is controlled by the motion of a valve element 10, which in co-operation with the valve seat element 8 opens and closes the valve port 9. This valve element 10 is coupled, via a valve rod 11, to a diaphragm device 12, and thus is operated by this diaphragm device 12. The diaphragm device 12 includes a diaphragm 13 which, when a vacuum of at least a certain predetermined value is not supplied to its vacuum chamber 14, is urged downwards in the figure by the biasing effect of a compression coil spring 15, and thus, via the valve rod 11, presses the valve element 10 against the valve seat 8, thus closing the valve port 9 and thus cutting off all exhaust gas recirculation through the exhaust gas recirculation passage 6. On the other hand, when a vacuum of at least said certain predetermined value is supplied to the diaphragm chamber 14 of the diaphragm device 12, this vacuum overcomes the force of the compression coil spring 15 and raises the diaphragm 13 as shown in the figure, thereby removing the valve element 10 from the valve seat 8, opening the valve port 9, and thus allowing exhaust gas recirculation by opening the exhaust gas recirculation passage 6.

The diaphragm chamber 14 of the exhaust gas recirculation control valve 7 is directly connected, through a passage 17, to an inlet vacuum port 16, which is in such a position in the inlet manifold 4 that it is upstream of the throttle valve 3 when the throttle valve 3 is in the fully closed position, as shown in FIG. 1 by the solid line, but is downstream of the throttle valve 3 when the throttle valve 3 is opened beyond a certain first opening position.

In the passage 17 which supplies vacuum to the diaphragm chamber 14 of the exhaust gas recirculation control valve 7 is provided a throttling element 18 of a fixed throttling performance. A vacuum control valve 19, further, is branched to the passage 17. The vacuum control valve 19 includes a diaphragm 20 which defines a diaphragm chamber 21 on its lower side in the figure and a diaphragm chamber 22 on its upper side in the figure. The diaphragm 20 is urged downwards in the diagram by the biasing action of a compression coil spring 23. The vacuum control valve 19 is provided with a valve port 24 opening to the inside of the diaphragm chamber 22 from the passage 17, at its part which is on the side of the exhaust gas recirculation control valve 7 from the throttling element 18, and this valve port 24 is opened and closed by a valve element 25 which is supported by the diaphragm 20.

Thus, when the pressure in the diaphragm chamber 21 exceeds the pressure in the diaphragm chamber 22 by a specified value, the resistance of the compression coil spring 23 is overcome, and the diaphragm 20 is shifted upwards in the figure, so that the valve port 24 is closed by the valve element 25. On the other hand, when the pressure in the diaphragm chamber 21 does not exceed the pressure in the diaphragm chamber 22 by the specified amount, the diaphragm 20 is moved downwards to the position shown in the diagram by the biasing force of the compression coil spring 23, and the valve element 25 is removed from the valve port 24, thus opening it.

The diaphragm chamber 21 is connected through a throttling element 28 which has a fixed throttling performance and a passage 29 to a pressure chamber 27 which is defined between the valve port 9 and an orifice element 26 which is located within the exhaust gas recirculation passage 6 upstream of the valve port 9 of the exhaust gas recirculation control valve 7. Thus, the pressure of the exhaust gases in the pressure chamber 27 is admitted to the diaphragm chamber 21, with the throttling or damping effect of the throttling element 28. On the other hand, the diaphragm chamber 22 is open to the atmosphere through an atmosphere inlet aperture 30, which is of a certain calibrated or metered size, and is also connected to a vacuum-operated valve device 33 through a throttling element 31, which has a fixed throttling performance, and a passage 32.

The valve port 34 of the valve device 33 is directly connected to one end of the passage 32 which leads to the diaphragm chamber 22, and the opening and the closing of this valve port 34 is controlled by a valve element 35. When the port 34 is open, the diaphragm chamber 22 is connected, via the throttling element 31 and the passage 32, to an atmosphere inlet aperture 36 which is provided within the valve device 33. The valve element 35 is coupled to a diaphragm 38 through a valve rod 37, and is thus operated by the diaphragm 38. The diaphragm 38 is biased upwards in the figure by the biasing effect of a compression coil spring 40, and therefore, when the vacuum in the diaphragm chamber 39, which is defined below, in the figure, the diaphragm 38, is less than a certain predetermined value, the diaphragm 38 is forced upwards in the figure by the biasing effect of the compression coil spring 40, so that the valve port 34 is closed by the valve element 35.

On the other hand, when the vacuum supplied to the diaphragm chamber 39 of the valve device 33 is of at least this predetermined value, then the effect of the compression coil spring 40 is overcome, and the diaphragm 38 is forced downwards in the figure, so that the valve element 35 is removed from the valve port 34, which is thereby opened.

The diaphragm chamber 39 is directly connected, through a passage 42, to an inlet vacuum port 41, which is located in the inlet manifold 4 in such a position that when the throttle valve 3 is not opened as far as a second predetermined opening position, which is further in the opening direction than the aforementioned first predetermined position, the inlet vacuum port 41 is downstream of the throttle valve 3, whereas, when the throttle valve is opened beyond this second predetermined opening position, as shown by a dotted line in the figure, the inlet vacuum port 41 is upstream of the throttle valve 3.

The exhaust gas recirculation control valve whose construction is explained above operates as follows.

When the throttle valve 3 is not opened beyond the inlet vacuum port 16, that is, during idling operation of the internal combustion engine, no inlet vacuum is presented to the inlet vacuum port 16, so that substantially it is at atmospheric pressure, and therefore the vacuum chamber 14 of the exhaust gas recirculation control valve 7 is supplied essentially with atmospheric pressure, and accordingly, by the biasing action of the compression coil spring 15, the valve element 10 closes the valve port 9 of the exhaust gas recirculation control valve 7 by pressing against the valve port 8, and, accordingly, no exhaust gas recirculation takes place.

When the throttle valve 3 is gradually opened, and passes the inlet vacuum port 16, this port 16 is substantially supplied with inlet vacuum, which is transmitted therefrom through the passage 17, and via the throttling element 18, and is supplied to the vacuum control valve 19 which controls it in a per se well known way, and is further admitted to the diaphragm chamber 14 of the exhaust gas recirculation control valve 7, whereby the exhaust gas recirculation control valve 7 is opened, and recirculation of exhaust gas is started.

When the opening of the throttle valve 3 is not so far as to reach or pass the inlet vacuum port 41, then inlet vacuum is supplied to the diaphragm chamber 39 of the valve device 33, so that the valve element 35 is pulled downward in the diagram by the diaphragm 38, and the valve port 34 is opened. Therefore, air at atmospheric pressure is admitted to the diaphragm chamber 22 not only through the atmosphere inlet aperture 30, but also through the throttling element 31, passage 32, and valve device 33 from the atmosphere inlet aperture 36, so that, compared with the case when the valve port 34 is closed, the effective atmosphere inlet cross-sectional area of the diaphragm chamber 22 is larger, and accordingly, the pressure within the diaphragm chamber 22 comes closer to atmospheric pressure more quickly; and, thereby, the balance pressure value of the vacuum control valve 19 becomes higher.

For this reason, the pressure in the pressure chamber 27 becomes higher, and there is a decrease in the difference between the pressure in the exhaust pipe 5 and the pressure chamber 27. Therefore, in this state, the exhaust gas recirculation amount is low, and exhaust gas recirculation is carried out at a comparatively low exhaust gas recirculation ratio. In other words, when the engine is operated in this way at a low load, exhaust gas recirculation is effected, but at a low exhaust gas recirculation ratio.

Now, when the throttle valve 3 is opened so far as to pass the inlet vacuum port 41, i.e., in other words, when the engine is operating at medium load, then substantially atmospheric pressure is presented to the inlet vacuum extraction port 41, and thus the valve element 35 is moved upwards in the figure by the action of the compression coil spring 40, and thus the valve port 34 is closed. Therefore, atmospheric pressure is only admitted to the second diaphragm chamber 22 of the vacuum regulation valve 19 through the atmosphere inlet aperture 30, and, compared with the situation previously described above, i.e., compared to low load operation, the effective atmosphere inlet cross sectional area of the second diaphragm chamber 22 is decreased, and there is therefore a higher vacuum in the diaphragm chamber 22, and, to this extent and thereby, the balance pressure value of the vacuum control valve 19 becomes lower. For this reason, the pressure in the pressure chamber 27 also becomes lower, and thus there is an increase in the difference between the pressure in the exhaust pipe 5 and the pressure in the pressure chamber 27, so that at this medium load the amount of exhaust gas recycled is larger, compared with low load operation, and thus exhaust gas recirculation is carried out with a comparatively high exhaust gas recirculation ratio.

Figure 2:
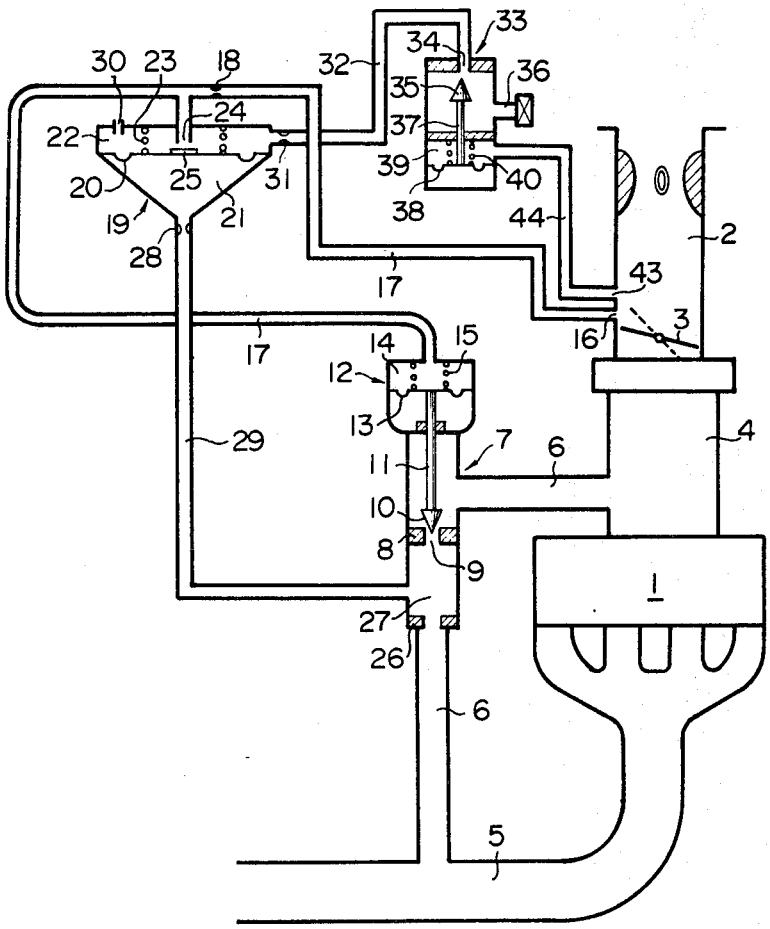
FIG. 2 is a schematic illustration, similar to FIG. 1, showing a second embodiment of the exhaust gas recirculation system of the present invention.

In FIG. 2, there is shown a further embodiment of the exhaust gas recirculation control system of the present invention, as fitted to an internal combustion engine. The portions of FIG. 2 which directly correspond to the same portions of FIG. 1 are designated by the same reference numerals. In this embodiment, the valve port 34 of the valve device 33 is closed by the valve element 35, when more than a certain vacuum is introduced into the diaphragm chamber 39, whereas, on the other hand, in response to a lowering of the vacuum in the diaphragm chamber 39, the effective passage cross sectional area of the valve port 34 is increased, by the biasing action of the compression coil spring 40, which pushes the valve element 35, valve rod 37, and diaphragm 38 downwards in the figure. The diaphragm chamber 39 is connected through a passage 44 to an inlet vacuum port 43, which is constructed to be upstream of the throttle valve 3 when the throttle valve 3 is less open than a certain second opening position, but to be downstream of the throttle valve 3 when the throttle valve 3 is opened to at least this second opening position, as in the position shown by the broken line in the figure.

In this case, when the opening of the throttle valve 3 is small, the inlet vacuum port 43 is substantially supplied with atmospheric pressure, but when the throttle valve 3 approaches the second opening position the inlet vacuum begins to take effect through the inlet vacuum port 43, and when the throttle valve 3 is opened beyond the second opening position the whole inlet vacuum takes effect through the port 43. If, furthermore, the throttle valve 3 is then again further opened, it then causes a decrease in the inlet vacuum effective at the inlet vacuum extraction port 43. For this reason, the valve port 34 of the valve device 33 is wide open when the internal combustion engine load is low, as in the first embodiment, and there is a similar rapid decrease in the effective passage cross sectional area of the port 34 as the load increases and the edge of the throttle valve 3 traverses the inlet port 43, so that the effective passage cross sectional area of the port 34 becomes small or zero only in a medium load range of the internal combustion engine. Therefore, in this embodiment, by the increase of supply of air at atmospheric pressure to the chamber 22, which as before controls the exhaust gas recirculation ratio in a per se well known way, when the internal combustion engine load is low, the exhaust gas recirculation ratio is low; and when the internal combustion engine load then increases, the exhaust gas recirculation ratio rapidly increases correspondingly, so as to be high in the medium load range of the internal combustion engine; and then, when the internal combustion engine load is yet further increased, into a high load range, the exhaust gas recirculation ratio is then again somewhat reduced.

Thus, in short, according to the present invention, it is possible to carry out exhaust gas recirculation at an exhaust gas recirculation ratio suitably adapted to the load on the internal combustion engine.

Although the present invention has been shown and described with reference to two preferred embodiments thereof, it should be understood by those whom it may concern that various modifications, alterations, and omissions of the form and the content of any particular embodiment of the present invention may be made therein by one skilled in the art thereof, without departing from the principles of the present invention, or from its scope. Therefore, it is desired that the scope of the present invention, and of the protection sought to be granted by Letters Patent, should be defined, not by any of the purely fortuitous details of the embodiments shown, or of the drawings, but solely by the appended claims.

I claim:

1. An exhaust gas recirculation system for an internal combustion engine comprising an exhaust passage, an inlet manifold, and a throttle valve in said inlet manifold, comprising:

an exhaust gas recirculation passage leading from a part of said exhaust passage to a part of said inlet manifold downstream of said throttle valve;

an orifice element provided within said exhaust gas recirculation passage;

an exhaust gas recirculation control valve, downstream of said orifice element in said exhaust gas recirculation passage, so as to define a pressure chamber in said exhaust gas recirculation passage between itself and said orifice element, comprising:

a first diaphragm;

a first diaphragm chamber, defined on one side of said first diaphragm, a first valve element coupled to said first diaphragm;

and a first valve port cooperating with said first valve element to form a variable aperture in said exhaust gas recirculation passage, so that an increase in the vacuum supplied to said first diaphragm chamber increases the opening amount of said variable aperture;

a first passage which supplies vacuum to said first diaphragm chamber;

a vacuum control valve, which comprises:

a second diaphragm;

a second diaphragm chamber, defined on one side of said second diaphragm to which is admitted the pressure of the exhaust gas in said pressure chamber;

a third diaphragm chamber, defined on the other side of said second diaphragm;

a second valve port communicating with said third diaphragm chamber to said first passage; and, a second valve element, supported by said second diaphragm, and cooperating with said second valve port so as to close said second valve port when the pressure in said second diaphragm chamber exceeds the pressure in said third diaphragm chamber by more than a certain amount, and so as to open said second valve port when the pressure in said second diaphragm does not exceed the pressure in said third diaphragm chamber by more than said certain amount;

and a means for admitting atmospheric air into said third diaphragm chamber, whose resistance to the passage of said atmospheric air is varied, in accordance with the inlet vacuum at a point in said inlet manifold which is upstream of said throttle valve when said throttle valve is opened to less than a certain predetermined opening, and which is downstream of said throttle valve when said throttle valve is opened to more than said predetermined opening, in such a way that said resistance is minimum when the vacuum at said point is minimum, and maximum when the vacuum at said point is maximum.

2. An exhaust gas recirculation system for an internal combustion engine comprising an exhaust passage, an inlet manifold, and a throttle valve in said inlet manifold, comprising:

an exhaust gas recirculation passage leading from a part of said exhaust passage to a part of said inlet manifold downstream of said throttle valve;

an orifice element provided within said exhaust gas recirculation passage;

an exhaust gas recirculation control valve, downstream of said orifice element in said exhaust gas recirculation passage, so as to define a pressure chamber in said exhaust gas recirculation passage between itself and said orifice element, comprising:

a first diaphragm;

a first diaphragm chamber, defined on one side of said first diaphragm;

a first valve element coupled to said first diaphragm;

and a first valve port cooperating with said first valve element to form a variable aperture in said exhaust gas recirculation passage, so that an increase in the vacuum supplied to said first diaphragm chamber increases the opening amount of said variable aperture;

a first passage which supplies vacuum to said first diaphragm chamber;

a vacuum control valve, which comprises:

a second diaphragm;

a second diaphragm chamber, defined on one side of said second diaphragm, to which is admitted the pressure of the exhaust gas in said pressure chamber;

a third diaphragm chamber, defined on the other side of said second diaphragm;

a second valve port communicating said third diaphragm chamber to said first passage; and, a second valve element, supported by said second diaphragm, and cooperating with said second valve port so as to close said second valve port when the pressure in said second diaphragm chamber exceeds the pressure in said third diaphragm chamber by more than a certain amount, and so as to open said second valve port when the pressure in said second diaphragm chamber does not exceed the pressure in said third diaphragm chamber by more than said certain amount; and, an air bleed valve comprising:

a second passage with its one end connected to said third diaphragm chamber;

a throttling element in said second passage;

a third valve port communicating with the other end of said second passage;

a third valve element cooperating with said third valve port to form a variable orifice communicating said second passage to the atmosphere;

a third diaphragm connected to said third valve element and defining a fourth diaphragm chamber on its side;

and a biasing element biasing said third diaphragm in the direction to remove said third valve element from said third valve port;

said fourth diaphragm chamber being supplied with inlet manifold vacuum from a point in said inlet manifold which is upstream of said throttle valve when said throttle valve is opened to less than a predetermined amount, and which is downstream of said throttle valve when said throttle valve is opened to more than said predetermined amount;

said supply of inlet manifold vacuum urging said third diaphragm in the direction to approach said third valve element towards said third valve port.

* * * * *